United States Patent [19]

Howard et al.

[11] Patent Number: 4,835,568

[45] Date of Patent: May 30, 1989

[54] REMOVABLE PROCESS UNIT WITH CHARGING DEVICE LOCATED RELATIVE TO MAIN ASSEMBLY

[75] Inventors: Alan C. R. Howard, Westoning; David M. Newbury, Welwyn Garden City, both of England

[73] Assignee: Xerox Corporation, Stamford, Conn.

[21] Appl. No.: 131,163

[22] Filed: Dec. 10, 1987

[30] Foreign Application Priority Data

Dec. 15, 1986 [GB] United Kingdom ..... 8629940

[51] Int. Cl.[4] ..... G03G 15/02

[52] U.S. Cl. ..... 355/219; 355/311; 355/221

[58] Field of Search ..... 355/3 CH, 3 TR, 3 DR, 355/3 SH, 3 R, 14 TR, 14 CH, 14 SH; 250/324–326

[56] References Cited

U.S. PATENT DOCUMENTS 4,386,838 6/1983 Hirabayashi et al. ..... 355/3 DR
4,668,072 5/1987 Yasuda ..... 355/3 BE

FOREIGN PATENT DOCUMENTS 60-73554 4/1985 Japan ..... 355/3 CH
61-97663 5/1986 Japan ..... 355/3 R
61-179468 8/1986 Japan ..... 355/3 CH

*Primary Examiner*—R. L. Moses

[57] ABSTRACT

A process unit which is removably mounted in the main assembly of a reproducing machine such as a xerographic copier, has a housing enclosing an imaging member and, optionally, other processing capability such as a development device, and a cleaner. The unit also has two charging devices, namely a charge scorotron and a transfer corotron which are mounted so as to have a limited degree of vertical movement relative to the unit housing. The charging devices are provided with spacers at their opposite ends which abut a support member in the main assembly when the process unit is inserted therein. In this way the charging devices are automatically accurately located relative to the imaging member when the process unit is inserted in its operative position in the main assembly. Preferably the charging devices are urged towards the support by springs which, in the case of the charge scorotron are included within the cassette housing and, in the case of the transfer corotron form part of the main assembly of the copier.

17 Claims, 10 Drawing Sheets

REMOVABLE PROCESS UNIT WITH CHARGING DEVICE LOCATED RELATIVE TO MAIN ASSEMBLY

CROSS REFERENCE TO RELATED APPLICATIONS

Reference is made to the following copending applications filed concurrently herewith: application Ser. No. 131,162 entitled "Process Unit For An Imaging Apparatus" in the name of Robert A. Carter (our reference R/86010); application Ser. No. 131,075 entitled "Press Unit For An Imaging Apparatus" in the name of Alan C.R. Howard et al.(our reference R/86011); applications Ser. No. 131,074 entitled "Process Unit For An Imaging Apparatus" in the name of Alan C. R. Howard et al(our reference R/86012); application Ser. No. 130,920 entitled "Electrostatographic Reproducing Machine and Process Unit Therefore" in the name of David M. Newbury (our reference R/86013); application Ser. No. 131,073 entitled "Fiber Traps In Copiers" in the name of Philip R. Thompson (our reference R/87006). Reference is also made to copending application Ser. No. 038,093 entitled "Process Unit For An Imaging Apparatus" filed Apr. 14, 1987 in the name of Robert A. Carter. (our reference R/86003).

BACKGROUND OF THE INVENTION

This invention relates to a process unit adapted to be removably mounted in a main assembly of a reproducing machine, the process unit comprising at least an imaging member and a charging device. The invention also relates to a reproducing machine, particularly a xerographic copying machine, including such a process unit.

Xerographic copying machines generally comprise two charging devices namely a charge corotron for initially charging the photoreceptor imaging member and a transfer corotron for attracting a toner image from the photoreceptor to a copy sheet. It is an important requirement that both corotrons are accurately and uniformly spaced from the photoreceptor in order to ensure a uniform charge distribution.

In Japanese Patent No. 0 109 371 to Kasama precise spacing between the corotron or a plurality of corotrons and the photoreceptor is achieved by having the corotron(s) pivotally mounted to the main assembly of the machine and the pivotable assembly is spring-biased towards the photoreceptor. With this arrangement the corotron(s) may be pivoted away from the photorecptor into a held-open position.

There is a trend now, however, to incorporate the photoreceptor together with other process means such as a charge corotron, a development device, and a cleaning device in a removable process unit or cassette as described, for example, in U.S. Pat. No. 3,985,436 to Tanaka et al. The use of such a cassette enables the easy replacement of those parts of the xerographic machine which are most likely to deteriorate with use, especially the photoreceptor, but also the development and cleaning systems as well as the charge corotron wire. A further advantage of containing the major xerographic process elements within a cassette is that interchangeable cassettes may be used in a given copying machine to provide different development characteristics or different coloured development.

Generally it is the case that the photoreceptor is located automatically in an operative position when the process unit is inserted into the main assembly of the copier, but there is still of course the requirement for the charging devices to be uniformly spaced from the photoreceptor.

Copending U.S. patent application Ser. No. 038,093 filed Apr. 14, 1987 entitled Process Unit For An Imaging Apparatus, in the name of Robert A. Carter, commonly assigned to the assignee of the present invention (our reference R/86003) concerns a process unit comprising a xerographic process cassette in which the imaging member, preferably in the form of a flexible belt photoreceptor, is only loosely retained in the process unit when the process unit is removed from the main assembly of the xerographic machine, and is adapted to be supported in an operative position by support means forming part of the main assembly when the process unit is inserted into the main assembly. This arrangement has the advantage of avoiding the need for any driving mechanisms within the cassette and also of making the insertion and withdrawal operations simple and reliable while ensuring that the photoreceptor is automatically positioned accurately relative to the optical system of the xerographic machine, but it does give rise to the problem of accurately locating the charging devices, i.e. the charge corotron and the transfer corotron, relative to the photoreceptor, because in the operative position the photoreceptor adopts a different position relative to the cassette as compared with its position when the cassette is removed from the main assembly of the copier.

PRIOR ART

U.S. Pat. No. 3,985,436 to Tanaka et al describes a copying machine with a removable processing cartridge which includes a photoreceptor drum, developing device, cleaning device and charge corotron.

U.S. Pat. No. 4,575,221 to Onoda et al. discloses a process unit, i.e. a so-called process kit, containing a photosensitive drum and a charge corotron in which the shield case of the corotron is fixed to the wall of the process kit, but the discharging wire is maintained at a predetermined spacing from the photosensitive drum by virtue of a floating mounting comprising slide pieces movable within the shield case in the direction perpendicular to the photosensitive drum and having a roller at the lower end of each slide piece which is in rolling contact with the drum surface. This arrangement relies on the rigidity of the photosensitive drum to achieve accurate uniform spacing between the corotron discharge wire and the photosensitive surface.

U.S. Pat. No. 4,591,258 to Nishino describes a processing cassette for image forming apparatus which has a driving connection member which is protected from shock and impact by two members which may contain electrical connectors projecting from the end of the driving connection member.

UK Patent No. 2168651B to Kubota et al describe a processing cassette for image forming apparatus wherein positioning means are provided on the main assembly for engaging corresponding location means on the process unit to operative position. Tapered pins on the process unit fit into holes on the main assembly and vice versa. See FIGS. 14, 15, 16.

SUMMARY OF THE INVENTION

According to a first aspect of the present invention there is provided a process unit adapted to be removably mounted in a main assembly of a reproducing machine, comprising a housing enclosing an imaging member, and a charging device, wherein the charging device is provided with projecitons which engage an abutment forming part of the main assembly whereby the charging device is located in a predetermined position relative to the main assembly when the process unit is inserted therein.

A process unit in accordance with the first aspect of the invention has the advantage that it enables accurate location of the charging device relative to the main assembly when the unit is inserted therein. A charging device may be either the transfer corotron or the charge corotron. By contrast with the prior art arrangement described in U.S. Pat. No. 4,575,221 the whole charging device is located relative to the imaging member thus avoiding the need for the discharging wires to be movable relative to the corotron shield, which has the advantage that the corotron wires can be mounted more simply in the shield.

According to a further aspect of the present invention there is provided a reproducing machine comprising a main assembly, a process unit in accordance with the first aspect of the invention, and an abutment which engages the projections on the charging device when the process unit is inserted in the main assembly.

In one embodiment the main assembly of the reproducing machine comprises a member for supporting the imaging member in an operative position when the process unit is inserted in the main assembly, and this support member may also serve as the abutment for the projections on the charging device. This has the advantage that it enables accurate location of the charging device relative to the imaging member, even in case where the imaging member is a flexible belt which is fully supported only when the unit is inserted in the main assembly of the copying machine.

In one example, the end of the charging device which is the leading end during insertion of the process unit into the main assembly is provided with an additional projection which is more protrusive than the projections intended for spacing. This additional projection serves to protect the adjacent spacer projection during insertion of the process unit by holding the spacer projection away from the abutment. Thus during the insertion operation it is the more protrusive protecting projection which bears against the abutment instead of the spacer projection. The abutment is provided with a recess which accommodates the more protrusive projection when the process unit is fully inserted in the main assembly thereby allowing the adjacent spacer projection to fulfill its intended role and engage the abutment.

In another aspect of the present invention spring means are included which bias the charge device towards the abutment. In one example, the spring means may be incorporated in the process unit, whereas in another example the spring means form part of the main assembly of the copier.

BRIEF DESCRIPTION OF THE DRAWINGS

Embodiments of the invention will now be described, by way of example, with reference to the accompanying drawings in which.

DETAILED DESCRIPTION OF THE INVENTION

Figure 1:
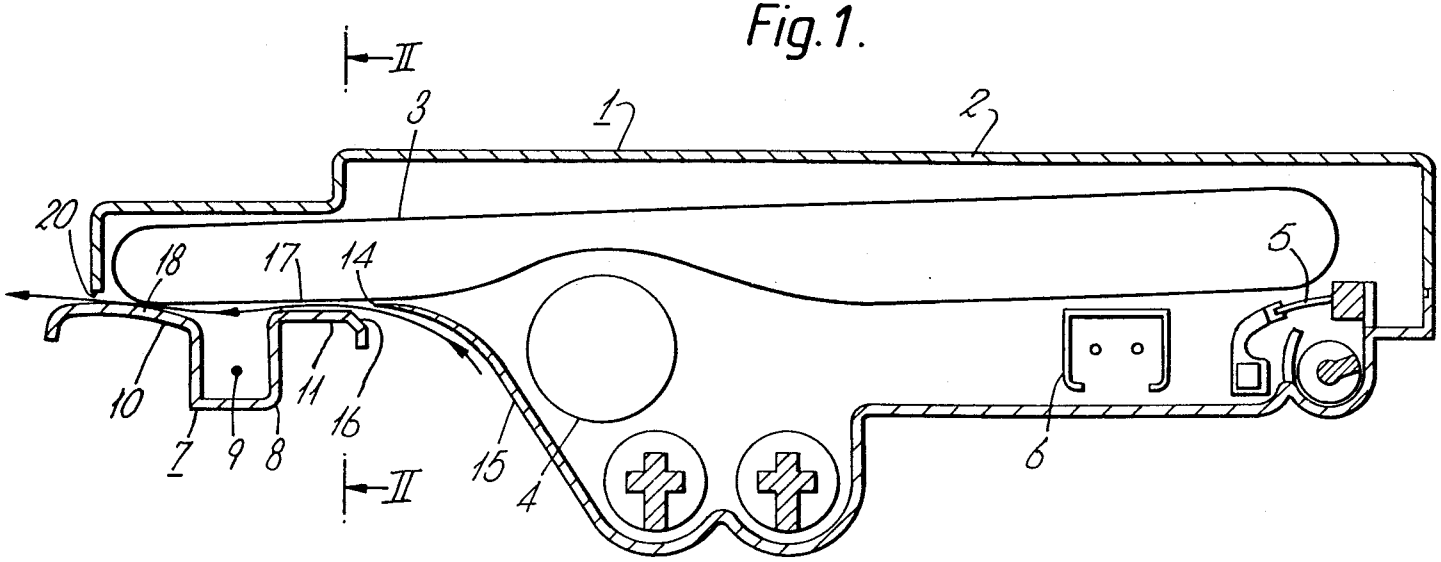
FIG. 1 is a schematic cross section of a process unit having an integral transfer corotron and containing a charge corotron.

It is noted that, for the sake of clarity, the FIGS. are not drawn to scale. In particular in the sectional views the dimensions in the vertical direction have been exaggerated. The same features are denoted by the same reference numerals in each of the FIGS.

The process unit or cassette 1 shown in FIG. 1 is designed to be removably mounted in the main assembly 100 of a xerographic copier 110 as described, for example, in the aforementioned U.S. patents and also in copending U.S. patent application No. 038,093 (our reference R/86003) to which reference is invited for further details. The cassette 1 comprises a housing 2 made for example, primarily of polystyrene, which encloses an imaging member in the form of a belt photoreceptor 3 in addition to various process means, in particular a development device 4, a blade cleaner 5, and a charge corotron 6. which is described in greater detail below with reference to FIGS. 11 and 12. The belt photoreceptor is an endless flexible belt having a photosenstive surface. In the arrangement shown, when the cassette 1 is removed from the main assembly 100 of the copier, the belt is only loosely retained in the cassette but when the cassette is inserted into the main assembly of the copying machine, the photoreceptor belt is supported in an operative position by a member 40 forming part of the main assembly (see especially FIG. 8). A cassette having this kind of loosely retained photoreceptor arrangement forms the subject of the aformentioned copending U.S. patent application No. 038,093.

Returning to FIG. 1, a transfer charging device 7 is included in the cassette housing in the vicinity of the photoreceptor belt at the area where a toner image is to be transferred from the belt to a copy sheet. The technique of actually transferring a toner image is well known to those skilled in the art and no further details need be given here. The transfer charging device is in the from of a corotron having an outer shield 8 which, as is conventional, is substantially U-shaped and made, for example, of stainless steel. A corona wire 9 extend the full lenght of the shield 8 and is spaced apart from the walls thereof in the usual manner.

Figure 2:
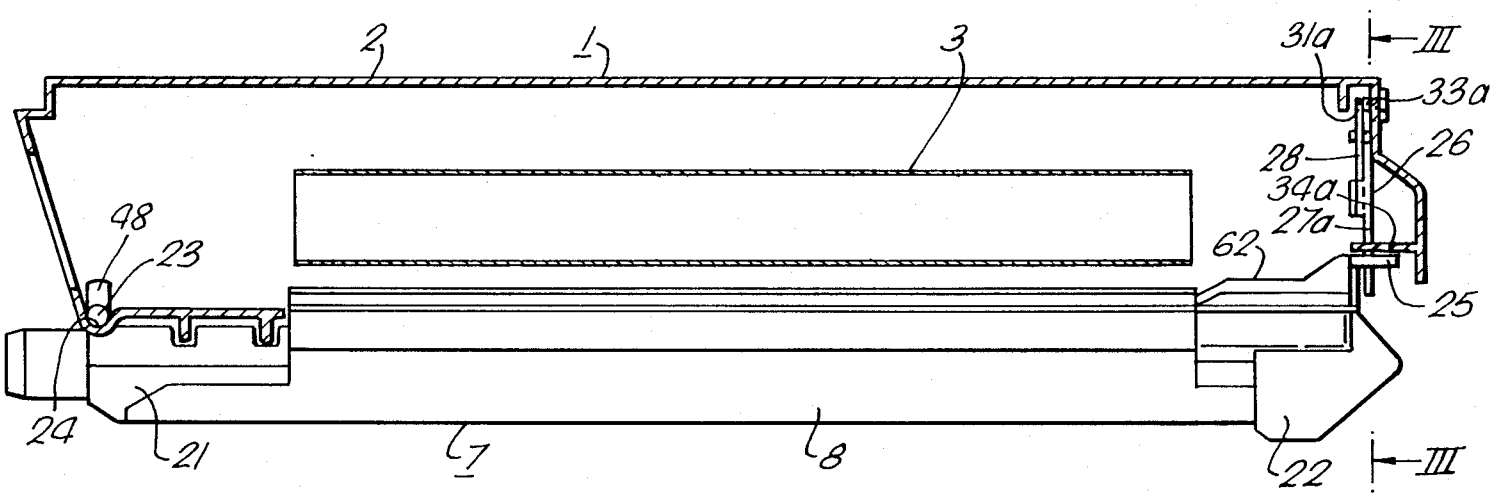
FIG. 2 is a schematic cross section of the process unit taken on the line II—II in FIG. 1.
Figure 3:
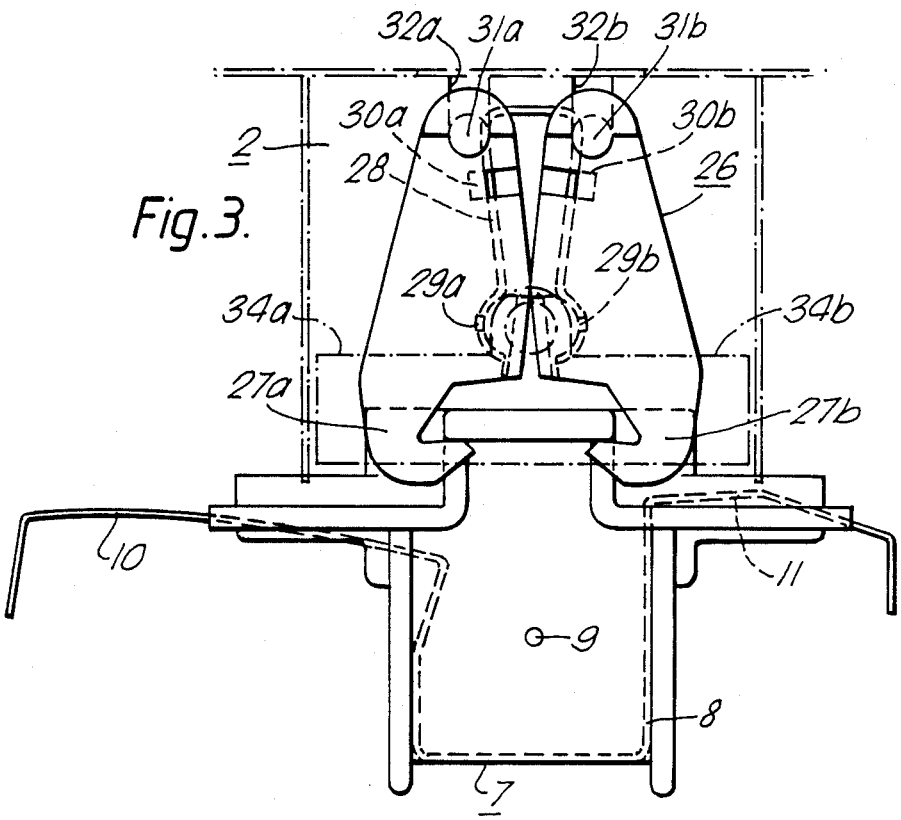
FIG. 3 is a cross section showing detail of a latch mechanism for retaining the corotron in the process unit taken on the line III—III in FIG. 2.

At it upper end the shield has extended portions 10 and 11 on its left- and right-hand sides respectively, as viewed in the drawing. These portions 10 and 11 define the path which a copy sheet follows as it passes through the cassette for the purpose of having a toner image transferred thereto, as described in more detail below. As shown in FIG. 2, the corotron 7 has end caps 21, 22 fastened to opposite ends of shield 8. The end caps 21, 22 are made of a plastics material. End cap 21 has a laterally-projecting pin extending from its side faces both into and out of the plane of FIG. 2. The pin 23 is accommodated in sockets 24 formed integrally in the cassette housing, two such sockets being provided, one on each side of the end cap 21. The pin and socket arrangement is such as to allow the corotron a small amount of vertical movement, typically 2 mm, at its pivoted end. At the opposite tab 25 which engages in a latch mechanism 26 shown more clearly in FIG. 3. The tab 25 is held by two jaws 27*a*, 27*b* of the latch which are biased together by an inverted keyhole-shaped spring 28. The spring 28 is held in place by pairs of tabs 29*a*, 29*b*; 30*a*, 30*b* formed integrally on the inward face of the jaws 27*a*, 27*b*. The upper portion of each jaw 27*a*, 27*b* is provided with a protruding post 31*a*, 31*b* with an enlarged head 33*a*, 33*b* extending from the outward face. The posts 31*a*, 31*b* are accommodated in slots 32*a*, 32*b* respectively in the cassette housing 2, thus providing a pivotal mounting for the jaws. The enlarged heads 33*a*, 33*b* which act to retain the latch in its own plane are present on the outside of the cassette housing as can be seen more clearly in FIGS. 2 and 6. The latch is also held in place by two bail bars 34*a*, 34*b* formed on a recessed portion of the internal wall of the cassette housing 2. The bail bars 34*a*, 34*b* are both joined to the cassette housing at each of their two ends, thereby providing a slot between the bars and the cassette housing through which the jaws 27*a*, 27*b* are threaded, thereby limiting their pivotal movement as well as holding them in their own plane (see FIG. 6). When the cassette is outside the main assembly of the copying machine, the jaws 27*a*, 27*b* of the latch 26 are closed to grip tab 25 and so support the corotron as shown in FIG. 3. However, the latch is adapted to be opened automatically to release the corotron when the cassette is inserted into the main assembly of a copying machine, which enables the corotron to be located accurately relative to the photoreceptor and also enables the corotron to be hinged open about pivot pin 23 to allow for clearance of jammed copy sheets, as described in more detail below.

As can be seen from FIGS. 1 and 2, the outside of the corotron shield 8 forms part of the external wall of the cassette housing 2.

Figure 4:
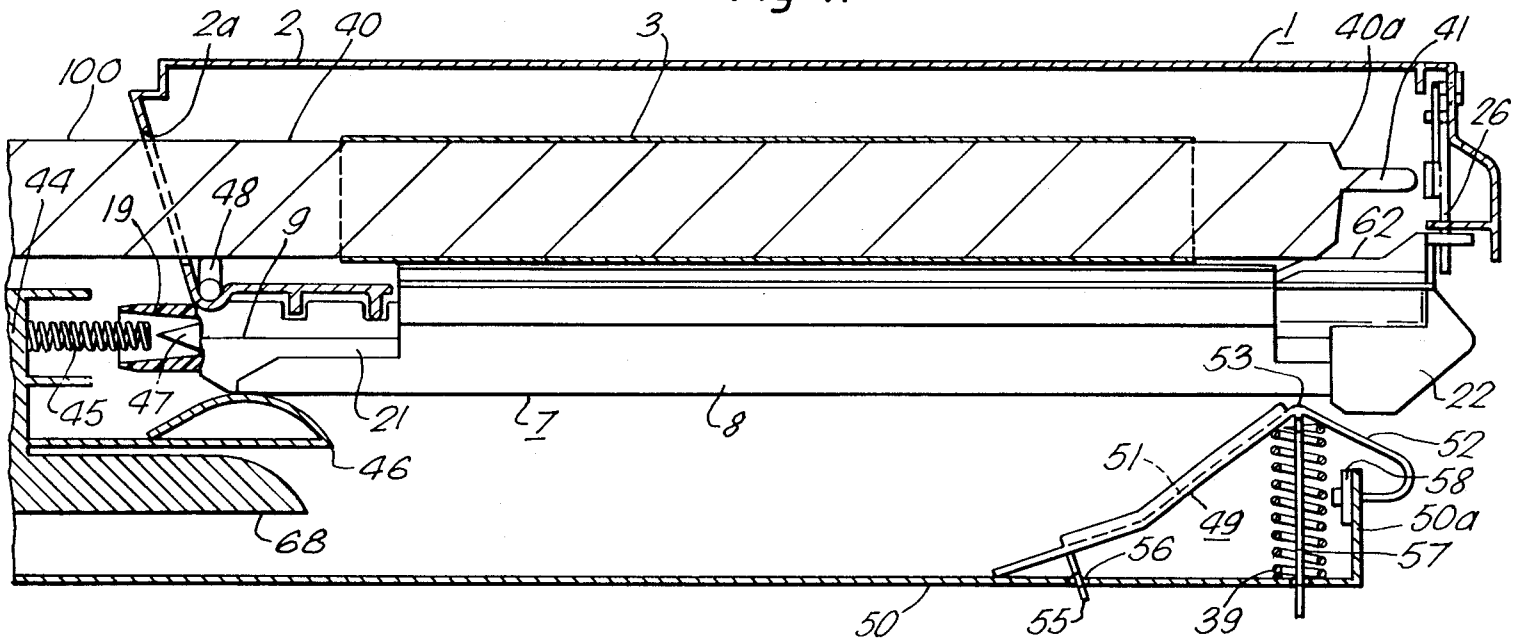
FIG. 4 is a sectional view of the process unit in FIG. 2 partially inserted in the main assembly of a xerographic copier.

FIG. 4 shows the situation as the cassette 1 is almost, but not quite, fully inserted into its operative position in the main assembly 100 of a reproducing machine. For the sake of clarity the whole of the machine main assembly is not shown in the FIG. As the cassette is first inserted into the main assembly, the support member 40, which is integral with the main assembly, enters the cassette 1 through aperture 2a in the housing 2 and threads through the belt photoreceptor 3. To facilitate this threading operation the support 40 is provided with a chamfered front end face 40a. Extending from the end face 40*a* is a spigot 41, the purpose of which is to actuate the latch mechanism 26 when the cassette is fully inserted in the main assembly as explained in more detail below.

With the cassette in the position shown in FIG. 4, electrical connection is about to be made with the corotron 7 by means of compression spring 45 which is fastened to block 44 of the main machine assembly. The spring 45 is electrically connected to a high voltage source. As the cassette approaches the position shown in FIG. 4, the spring 45 enter the tapered bore of socket member 19 projecting from the leading face of the corotron end cap 21. In FIG. 4, the socket member is cutaway to show more clearly the features being discussed here. As the cassette continues to be inserted the spring 45 engages around electrical contact 47 protruding within the socket 19. Contact 47 is tapered in such a manner as to permit the spring 45 to thread over it easily and to ensure intimate electrical contact therewith. The contact 47 is electrically connected to corona wire 9.

With the cassette at the position shown in FIG. 4, the underside of leading end cap 21 has just engaged leaf spring 46 which extends cantilever-fashion from the block 44 of the main assembly 100. Spring 46 acts to urge the corotron 7 up towards the support 40 until a projection 48 provided on the upper surface of end cap 21 abuts the underside of support member 40. Projection 48 thus acts as a spacer.

At the same time the end cap 22 at the trailing end of the corotron approaches ramp flexure 49 fastened on a surface 50 which may be withdrawn as a single entity from the main assembly of the reproducing machine as discussed in more detail below.

Figure 5:
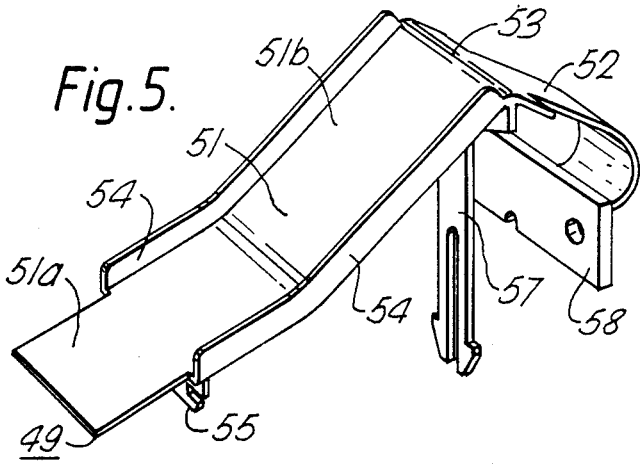
FIG. 5 is a perspective view of a ramp flexure member which supports the transfer corotron in the main assembly.

The ramp flexure 49 which is shown in more detail in FIG. 5 is made of plastics material, for example polypropylene and comprises a double ramp 51, 52 in back-to-back configuration defining an apex 53 therebetween. The inwardly extending ramp 51 comprises a lower sloping portion 51*a* and an integral upper portion 51*b* which is more steeply inclined. The ramp 51 is slightly wider than the corotron end cap 22 and is provided with upstanding wall portions 54 at its edges, thus presenting a guide channel for the corotron. Extending from the underside of lower ramp portion 51*a* is a T-shaped lug 55 which extneds through a slot 56 in the surface 50 to lock the ramp member 59 thereto. The ramp member is further fastened to the surface 50 by a bifurcated barbed member 57 extending through a slot 58 in the surface 50. The outwardly extending ramp portion 52 is shorter than the inwardly extending portion 51 and at its lower end curves inwardly and terminates in a block 58 which is bolted to an upstanding flange 50*a* at the outside edge of surface 50. The ramp portion 52 provides a guide surface for the leading end cap 21 of corotron 7 when the cassette is first inserted into the main assembly 100.

Figure 6:
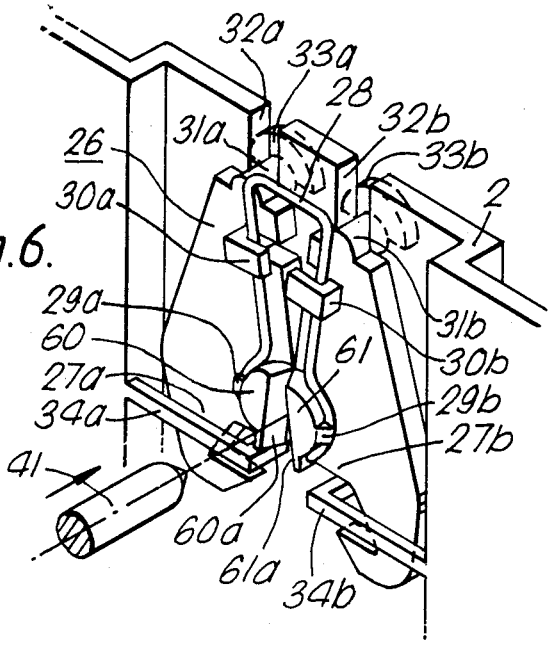
FIG. 6 is a perspective view of the latch in the closed position when the process unit is partially inserted into the main assembly.
Figure 7:
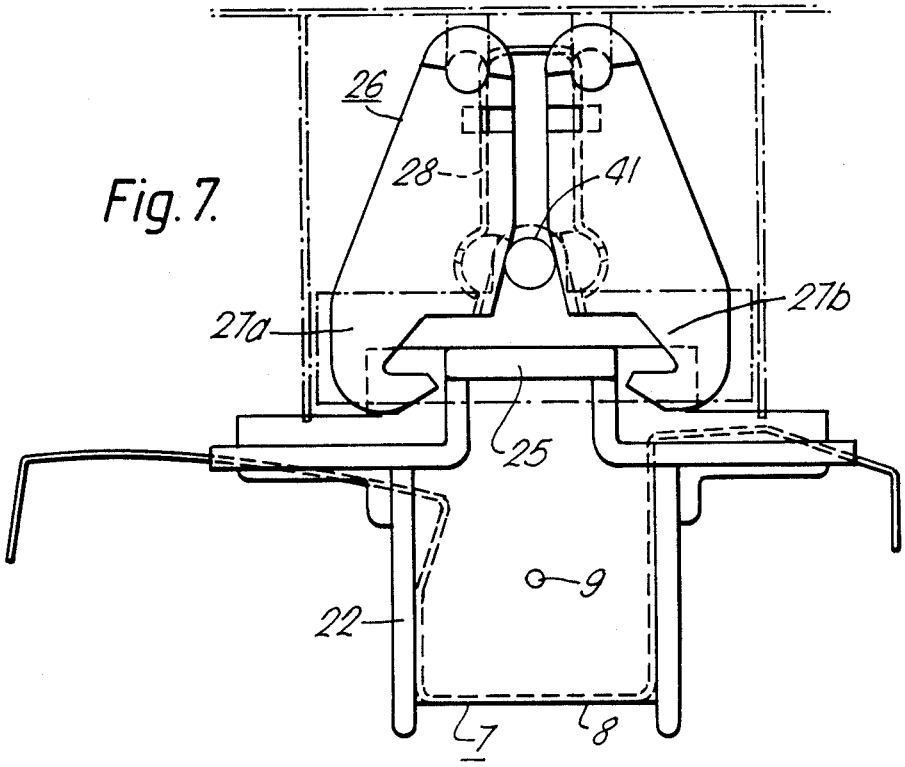
FIG. 7 is a cross section showing detail of the latch mechanism of FIG. 2, but with the latch in the open position.

As the cassette is inserted further, the spigot 41 of the support member 40 approaches the latch mechanism 26. Referring to FIG. 6, it can be seen that the spigot 41 is aligned with two subtantially semicircular boss members 60, 61 at the facing edges of the two jaws 27*a*, 27*b*. The boss members 60, 61 are each chamfered at their inwardly directed faces 60*a*, 61*a* respectively. As the cassette approaches its fully inserted position within the main assembly 100 the spigot 41 engages the bosses 60, 61 at their chamfered surfaces 60*a*, 61*a* and prizes them apart against the bias of spring 28, thus forcing the jaws 27a, 27b to move apart thereby releasing tab 25 of corotron end cap 22 as shown in FIG. 7. At this stage the trailing end of the corotron will drop slightly under its own weight until it abuts ramp portion 52 of ramp flexure 49.

Figure 8:
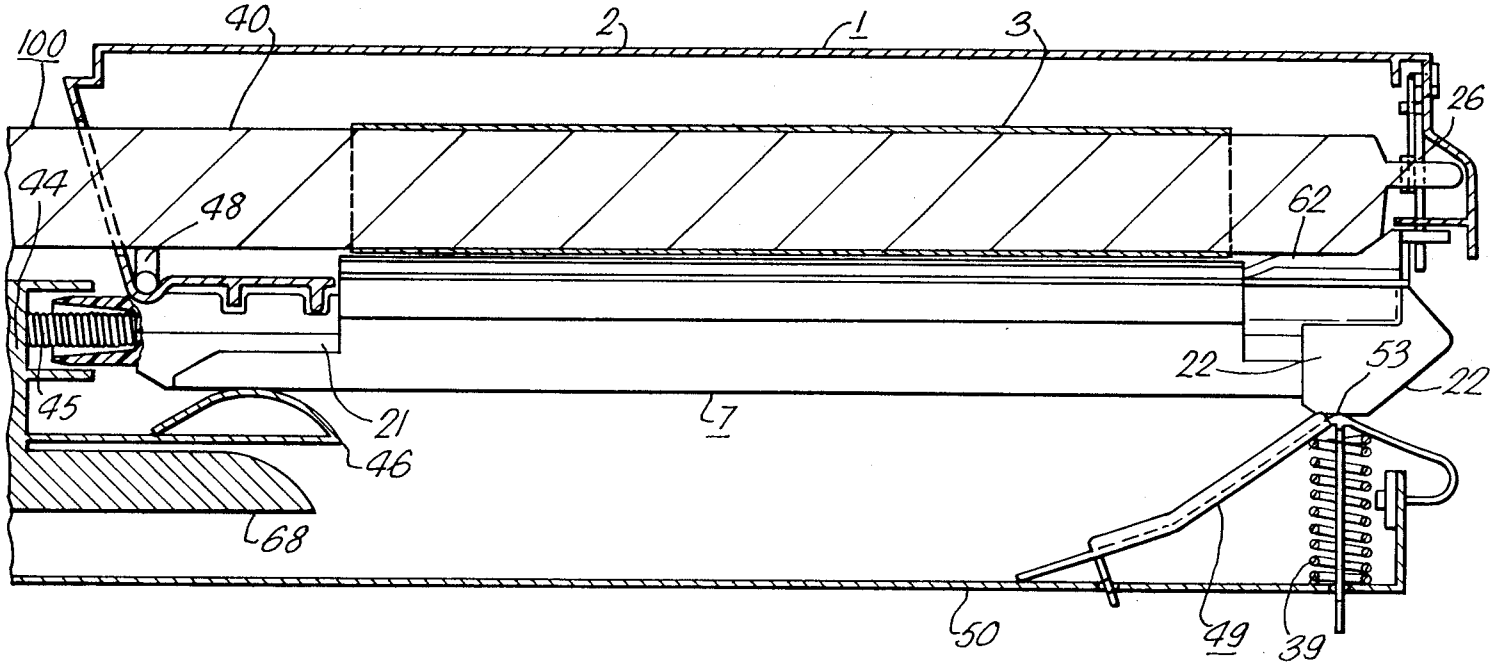
FIG. 8 is a sectional view of the process unit of FIG. 2 fully inserted in the main assembly.
Figure 9:
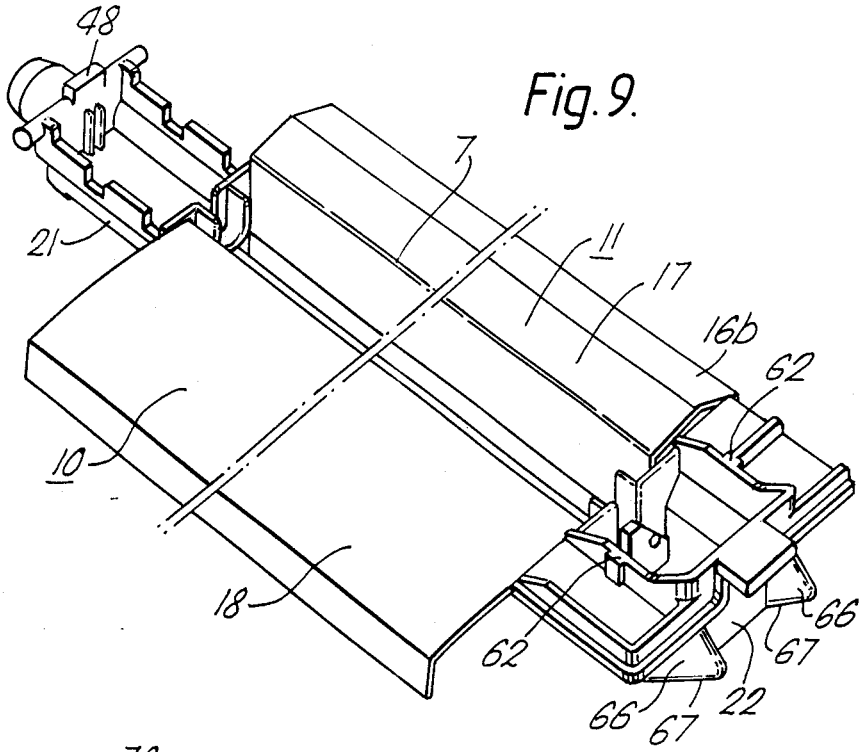
FIG. 9 is a perspective view of the transfer corotron.

The cassette is then pushed all the way to its fully inserted position in which the underside of end cap 22 is supported by the apex 53 of ramp flexture 49, as shown in FIG. 8. The ramp flexure 49 acts to urge the trailing end of the corotron up towards the support 40 until two flange-like projections 62 provided on the top side of end cap 22 abut the underside of support member 40 and thus act as spacers. Thus the projection 48 on end cap 21 and the two projections 62 on end cap 22 which can be seen most clearly in FIG. 9 act as spacers which accurately locate the corotron 7 relative to the support member 40.

As described in aforementioned copending U.S. patent application No. 038,093 the photoreceptor belt 3 may be tensioned after the cassette has been fully inserted in the main assembly, e.g. by using a pair of rollers (not shown here) which can be moved apart, whereupon the belt 3 will adopt an operative position in which it conforms closely with the support member 40. It follows, therefore, that by accurately locating the corotron 7 relative to the support member 40 it is also located accurately relative to the photoreceptor, as required.

Although the ramp flexure 49 may itself be sufficiently resilient to urge the corotron 7 against the suport member 40 additional bias may be provided by threading a compression spring (not shown) over bifurcated member 57 so that it buts against the apex 53 of the flexure 49 at is upper end and against the surface 50 at its lower end.

As shown in FIG. 1, an aperture 14 is present between the right-hand extension 11 of corotron sheild 8 and the main part of the cassette housing to enable a copy sheet to enter the process unit for the purpose of transferring an image thereto from the photoreceptor belt 13 in the vicinity of the transfer corotron when the cassette is inserted into the main assembly of the copyingmachine. The aperture 14 is in the form of a slot extending substantially the full width of the cassette and is relatively narrow, for example, 2 mm wide. Thus the slot is sufficiently wide to permit a copy sheet to enter the cassette, but narrow enough to provide appreciable protection for the photoreceptor from damage, contamination, and light exposure, thus prolonging the useful life of the photoreceptor.

The path while a copy sheet follows as it passes through the cassette for image transfer purposes is denoted by an arrow in FIG. 1. The external wall portion 15 of the main part of the cassette housing is shaped so as to deflect and guide the approaching copy sheets towards the aperture 14. Furthermore, the extreme right-hand side of the extended portion 11 of corotron shield 8 has a downturned lip 16 inclined obtusely relative to the adjacent plateau portion 17. The downturned lip 16 thus also acts to guide approaching copy sheets towards the aperture 14.

As the copy sheet enters the cassette it follows the path defined between the photoreceptor belt 3 and the plateau portion 17 of the corotron shield extension 11. The copy sheet then passes over the main part(i.e. the shield 8 and the wire 9) of the transfer corotron 7 where the toner image is transferred from the photoreceptor belt to the copy sheet itself in known manner. From there the copy sheet transverses the slightly upwardly inclined ramp 18 forming part of the shield extension 10 on the left-hand side of the corotron 7, and thence to aperture 20 in the cassette housing where the copy sheet exits the cassette for further processing, in particular for the toner image to be fixed permanently to the copy sheet using techniques well known to persons skilled in the art.

Figure 10:
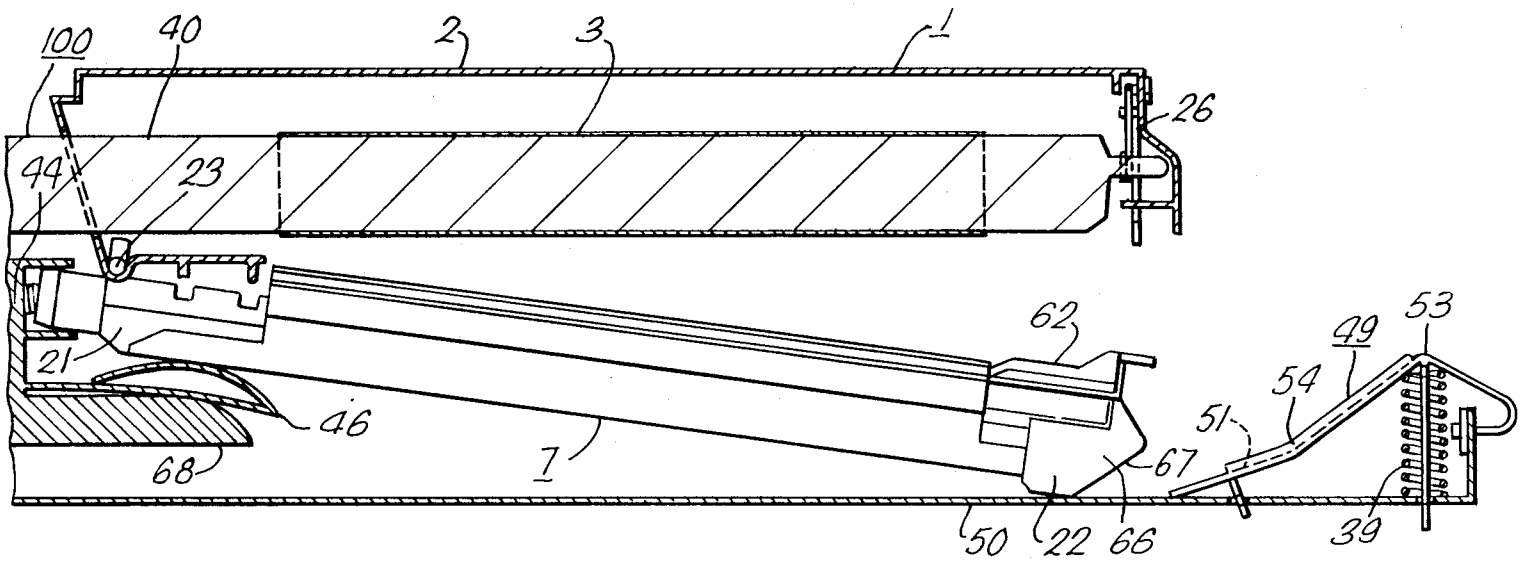
FIG. 10 is a sectional view of the process unit of FIG. 8 when it is fully inserted in the main assembly with the transfer corotron in its hinged-open position.

In case a copy sheet becomes jammed while it passed through the cassette 2, surface 50 with the ramp flexure 49 mounted thereon may be withdrawn manually from the main assembly 100 of the reproducing machine when the cassette is fully inserted therein, as shown in FIG. 10. As the surface 50 and ramp 49 are withdrawn the end cap 22 of corotron 7 will begin to descend the ramp 51 of ramp flexure 49, because it is no longer retained by latch 26. The end cap 22 is guided down the ramp 51 by edge wall portions 54. As the free end of the corotron descends, it pivots about hinge pin 23 at the other end cap 21. Leaf spring 46 is displaced against subjacent platform 68 extending from the block 44 in the main assembly 100. As the surface 50 continues to be withdrawn, the corotron end cap 22 continues to descend ramp portion 51 until it engages the surface 50 which limits the corotron's pivotal movement. FIG. 10 shows the corotron 7 hinged in it fully open position away from the photoreceptor to permit access to the transfer region of the cassette, especially for clearing copy sheet which my have jammed there without damaging the photoreceptor. Once the jam has been cleared, the corotron 7 is returned to is former operative position simply by reinserting surface 50. Initially the end cap 22 will slide along the surface 50 until the ramp reflexure 49 approaches when it will begin to ascend ramp portion 51 again guided by edge wall portions 54. For this purpose, end cap 22 is flanked by a pair of wings 66 with outwardly extending sloping faces 67 complementary to ramp 51 to facilitate sliding thereover. When the surface 50 is returned to its fully inserted position, the corotron end cap 22 reverts to its former position at the apex 53 of ramp flexure 49 with the projecting flanges 62 abutting the supporting member 40 of the main assembly 100, as shown in FIG. 8. When it comes to removing the cassette 1 from the main assembly 2 the spigot 41 of support 40 disengages from the latch 26 whereby the jaws 27a, 27b of the latch close together under the bias of spring 28 to regrip the tab 25 of corotron end cap 22. Thus, when the cassette is removed from the main assembly the transfer corotron is automatically latched back into, and as such again becomes an integral part of, the cassette housing 2.

The charge corotron 6, which is used to apply a uniform charge to the photoreceptor prior to the formation of a latent electrostatic image thereon in known manner, may also be mounted in such manner that when the cassette 1 is inserted into the main assembly 100 it is located automatically relative to the belt photoreceptor 3. The self-locating mounting of the charge corotron 6 will now be described.

Figure 12:
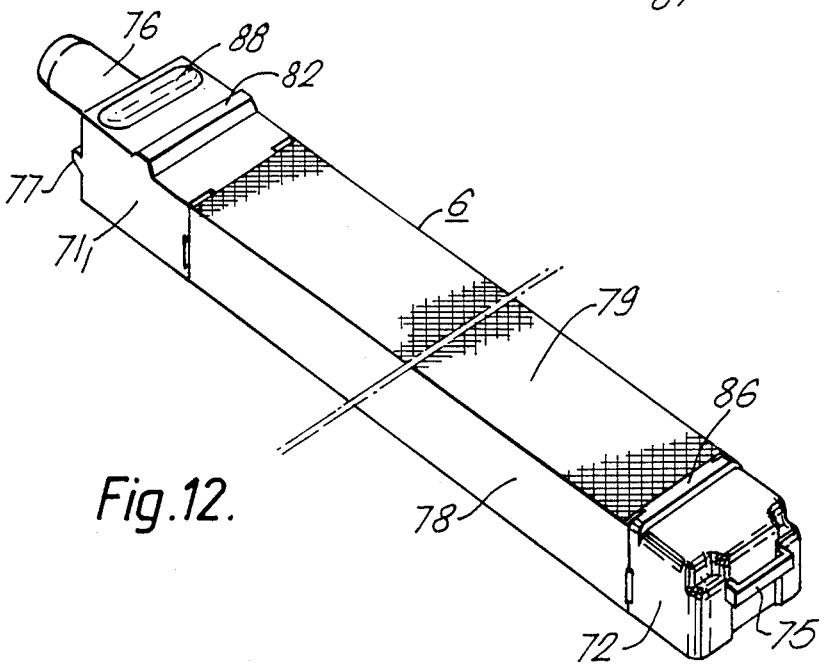
FIG. 12 is a perspective view of the charge corotron.
Figure 11:
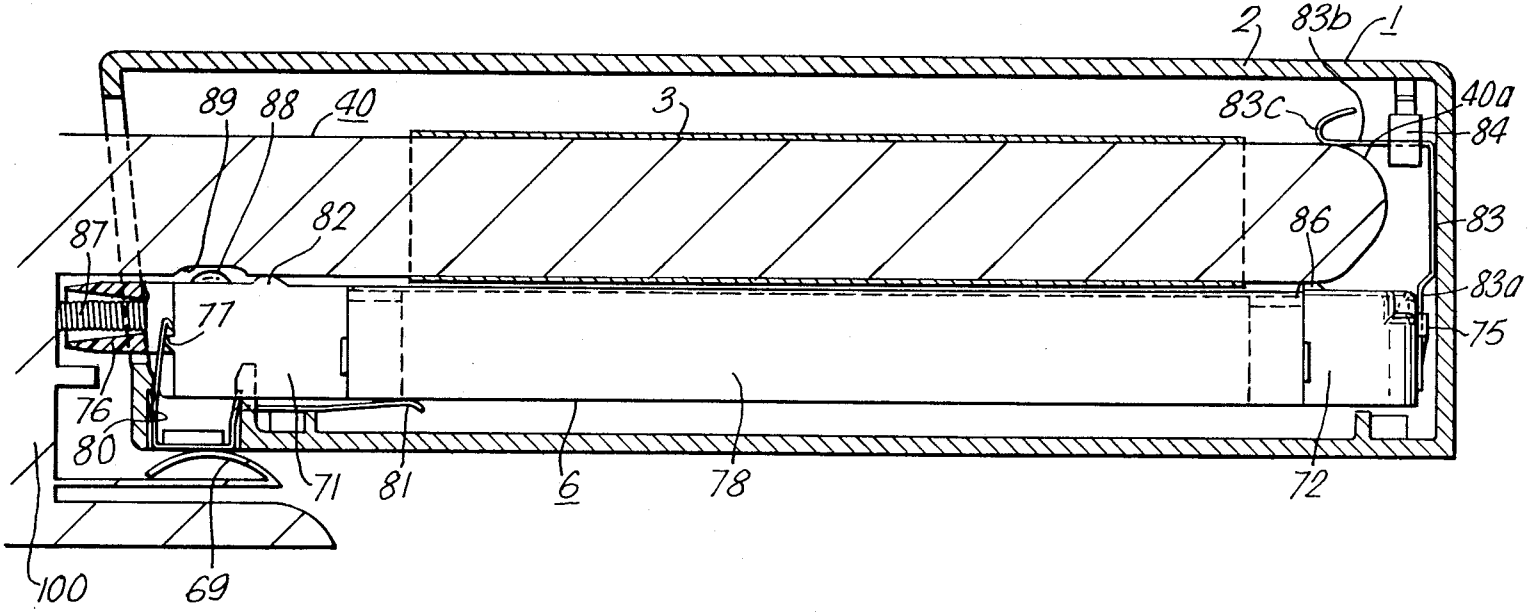
FIG. 11 is a schematic cross section of the process unit at the area of the charge corotron.

As shown in FIGS. 11 and 12 the charge corotron 6 is a screen controlled corona charging device, known in the art as a "scorotron", comprising a substantially U-shaped shield member 78 made of stainless steel having a grid or screen 79 covering the upper face, which can be seen most clearly in FIG. 12. When the scorotron 6 is in the operative position in the main assembly the screen 79 faces the photoreceptor 3 (see FIG. 11). Two equally spaced corona discharging wires (not shown) extend th full length of the shield 78 and are spaced apart from the walls of the shield in usual manner. The scorotron 6 has end caps 71, 72 made of plastics material which are fastened to opposite ends of shield 78. End cap 71 has a socket member 76 projecting therefrom for the purpose of facilitating electrical connection to the discharging wires in an analogous manner to the transfer corotron as described in more detail below.

The scorotron 6 is mounted in the cassette housing 2 in such manner that it has a limited amount of freedom to move in the vertical direction. The left-hand end cap 71 is restrained by a bifurcated clip 80 which extends around each side of the socket 76 and hooks over a pair of projections 77 which are diposed one on either side of the socket 76 integrally with the end cap 21. The clip 80 is fastened to the base of the cassette housing 2. As shown in FIG. 11, the hooked end of clip 80 is vertically spaced apart from the projection 77 because although the clip 80 acts as a vertical restraint, it does permit a limited amount of vertical movement as mentioned previously. A leaf spring 81, also fastened to the base of the cassette housing and integral with clip 80 bears against the underside of scorotron shiel 78 to urge the scorotron 6 up towards the support 40 in the main assembly 100 until a projection 82 provided in the upper surface of the end cap 71 abuts the underside of support member 40. Projection 82 thus acts as a spacer and is formed by a flat-topped rib extending the full width of the end cap 71 as can be seen more clearly in FIG. 12.

At the right-hand end the scorotron is supported by a resilient inverted L-shaped bracket 83 fastened to a weak flexure 84 in the top of the cassette housing 2, which weakly biases end cap 72 down towards the base of the cassette. This mounting also permits a limited amount of vertical movement to the scorotron. The upright arm 83*a* of bracket 83 is retained in a slot (not shown) against the cassette housing 2. At its lower end arm 83*a* bends away from the cassette housing and is fastened to the end cap 72 where it clips through a bail bar 75 present on the end face thereof.

FIG. 11 shows the situation in which the cassette 1 is fully inserted in the main assembly 100 of the reproducing machine and it can be seen that the lateral portion 83*b* of bracket 83 engages the upper surface of support member 40 thereby urging the right-hand end of the scorotron 6 up towards the support 40 until a projection 86 provided on the upper surface of end cap 72 abuts the underside of support member 40. Projection 86 thus acts as a spacer and, like spacer 82 on end cap 71, is formed by a flat-topped rib extending the full width of the end cap (see FIG. 12). Thus the spacers 82 and 86 on the end cap 71 and 72 respectively accurately locate the scorotron relative to the support member 40 and, so it follows, that the scorotron 6 is also located accurately relative to the operative position of the photoreceptor belt 3, as desired.

When the cassette is in the fully inserted position, as shown in FIG. 11, electrical connection is made to the corona wires in the scorotron by means of a coil spring 87 which enters tapered socket member 76 of the end cap 21 to connect with a tapered contact member (not shown) in exactly the same way as described above in respect of the transfer corotron 7. The spring 87 is fastened to the main assembly 100 and is electrically connected to a high voltage source. The screen 79 of the scorotron 6 is also connected to a potential source and is suitably operated at a potential of between zero and several hundred volts, depending on the potential required on the photoreceptor. The potential is applied to the screen 79 via leaf spring 81 in the cassette and via leaf spring 69 which extends cantilever-fashion from the block 44 of the main assembly and which engages an exposed portion of leaf spring 81 in the base of the cassette housing. The specific potentials for operating the scorotron are not directly relevant to the subject matter of the present invention and are largely a matter of design choice well within the capabilities of a person skilled in the art and so no further details will be given here.

End cap 71 is also provided on its upper surface with a rounded projection 88 disposed between the spacer of 82 and socket 76. Projection 88 is slightly more protrusive than rib 82. As can be seen in FIG. 11, when the cassette is in the fully inserted position, the projection 88 is accommodated in recess 89 provided in the underside of support member 40. The purpose of projection 88 is to protect the rib 82 during insertion of the cassette into the main assembly. It will be appreciated that rib 82 on end cap 71 is more vulnerable than rib 86 on end cap 72 because cap 71 is the leading end cap during cassette insertion and without the presence of protecting projection 88 rib 82 would bear against the underside of support member 40 during virtually the entire insertion operation. By contrast rib 86 engages the support member 40 only for the very last part of the insertion operation. Thus rib 82 is susceptible to damage during cassette insertion which would adversely affect the accurate spacing between the scorotron 7 and the photoreceptor belt 3. To avoid this, projection 88 is provided which during cassette insertion, itself bears against the support member 40 and keeps rib 82 out of contact with member 40 until the cassette reaches its fully inserted position at which stage the projection 88 locates in the recess 89 of support member 40 whereupon rib 88 becomes operative as a spacer and engages member 40.

As at the area of the transfer corotron 7 described previously, the support member 40 has a chamfered front face 40*a* to facilitate threading the belt photoreceptor 3. This profile also assists initial engagement with the scorotron mounting bracket 83 when the trailing part of the cassette enters the main assembly. Furthermore, the leading end of lateral portion 83*b* of the bracket 83 is bent back upon itself to present a rounded leading edge 83*c* to the chamfered face 40*a* of support member 40.

Figure 13:
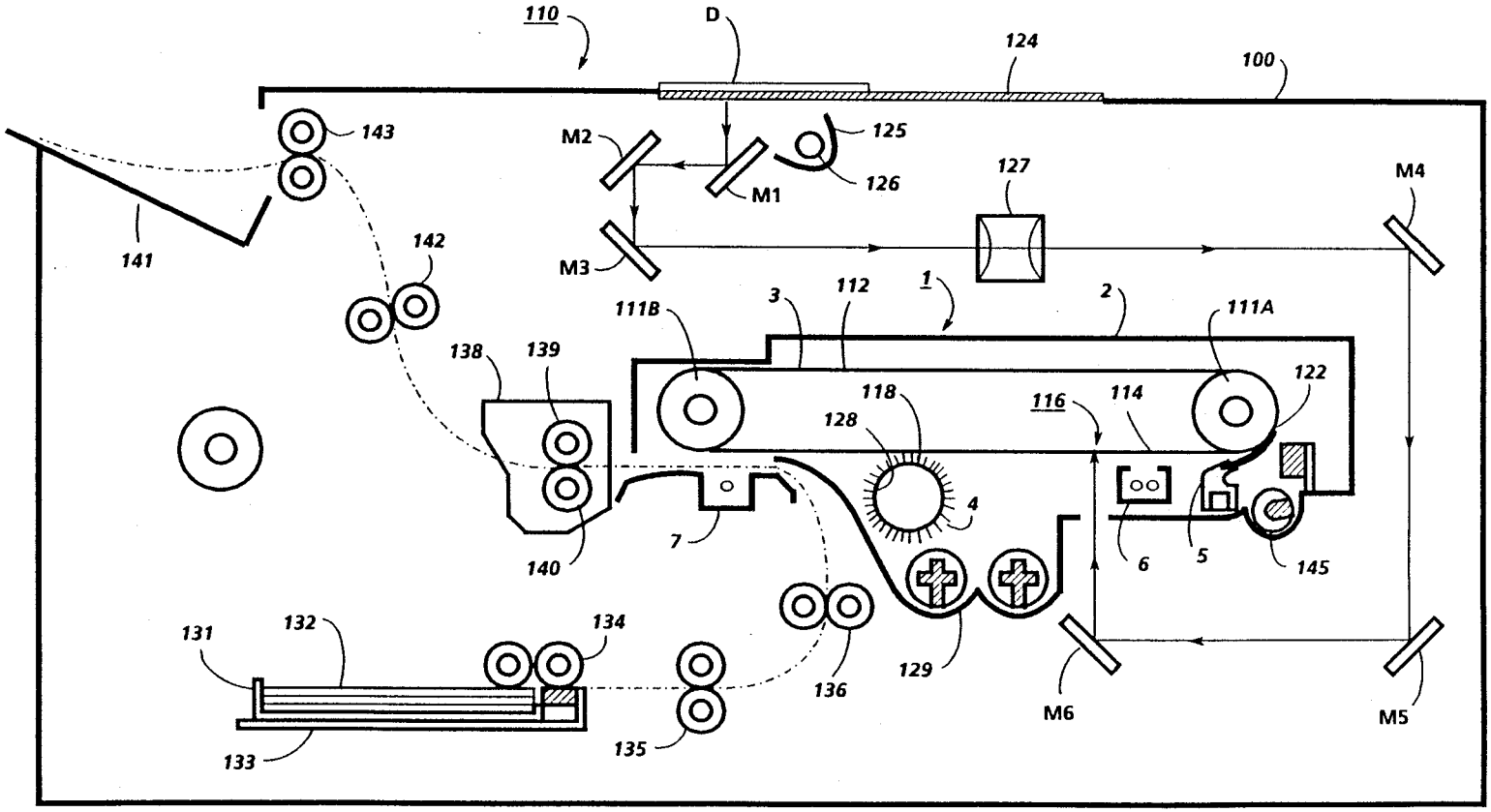
FIG. 13 is a schematic view in cross section of a reproducing machine having a process cassette according to the present invention.

Referring now to FIG. 13, there is shown schematically a xerographic printing machine 110 having the removable process unit 1 of the present invention. The machine includes and endless flexible photoreceptor belt 3 mounted for rotation in the clockwise direction as shown about support rollers 111*a* and 111*b* to carry the photosensitive imaging surface 112 of the belt 3 sequentially through a series of xerographic processing stations, namely a charging station 114, an imaging station 116, a development station 118, a transfer station 120, and a cleaning station 122.

The charging station 114 comprises a corotron 6 which deposits a uniform electrostatic charge on the photoreceptor belt 3. The photoreceptor belt 3, the charge corotron 6, the developer device 4, the transfer corotron 7, and the blade cleaner 5 may all be incorporated in a process cassette 1 adapted to be removably mounted in the main assembly 100 of the xerographic copier as described in aforementioned copending application Ser. No. 038,093.

An original document D to be reproduced is positioned on a platen 124 and is illuminated in known manner a narrow strip at a time by a light source comprising a tungsten halogen lamp 126. Light from the lamp is concentrated by àn elliptical reflector 125 to cast a narrow strip of light on the side of the original document D facing the platen 124. Document D thus exposed is imaged on to the photoreceptor 3 via a system of mirrors M1 to M6 and a focusing lens 127. The optical image selectively discharges the photoreceptor in image configuration, whereby an electrostatic latent image of the original document is laid down on the belt surface at imaging station 116. In order to copy the whole original document the lamp 126, the reflector 125, and a mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 3 is also in motion whereby the image is laid down strip by strip to reproduce the whole in the original document as an image on the photoreceptor.

By varying the speed of the scan carriage relative to the photoreceptor belt 3 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 127 along its optical axis closer to the original document i.e. closer to mirrors M2 and M3, magnification greater than unity, and away from the mirrors M2 and M3 for reduction, i.e. magnification less than unity. When the lens 127 is moved, the length of the optical path between the lens and the photoreceptor, i.e. the image distance, is also varied by moving mirrors M4 and M5 in unison to ensure that the image is properly focused on the photoreceptor 3. For this purpose mirrors M4 and M5 are suitably mounted on a further carriage (not shown).

At the development station 118, a magnetic brush developer device with a developer roll 128 develops the electrostatic latent image into visible form. Here, toner is dispensed from a hopper (not shown) into developer housing 129 which contains a two-component developer mixture comprising a magnetically attractable carrier and the toner, which is deposited on the charged area of belt 3 by a developer roll 128.

The developed image is transferred at transfer station 120 from the belt to a sheet of copy paper which is delivered into contact with the belt in synchronous relation to the image from a paper supply system 131 in which a stack of paper copy sheets 132 is stored on a tray 133. The top sheet of the stack in the tray is brought, as required, into feeding engagement with a top sheet separator/feeder 134. Sheet feeder 134 feeds the top copy sheet of the stack towards the photoreceptor around a 180° path via two sets of nip roll pairs 135 and 136. The path followed by the copy sheets is denoted by a broken line. At the transfer station 120 a transfer corotron 7 provides an electric field to assist in the transfer of the toner particles thereto.

The copy sheet bearing the developed image is then stripped from the belt 3 and subsequently conveyed to a fusing station 138 which comprises a heated roll fuser 139 to which release oil may be applied in known manner. The image is fixed to the copy sheet by the heat and pressure in the nip between the two rolls 139 and 140 of the fuser. The final copy is fed by the fuser rolls into catch tray 141 via two further nip roll pairs 142 and 143.

After transfer of the developed image from the belt some toner particles usually remain on the surface of the belt, and these are removed at the cleaning station 122 by a cleaner blade 5 which scrapes residual toner from the belt. The toner particles thus removed fall into a receptacle 145 below. Also, any electrostatic charges remaining on the belt are discharged by exposure to an erase lamp 146 which provides an even distribution of light across the photoreceptor surface. The photoreceptor is then ready to be charged again by the charging corotron 6 as the first step in the next copy cycle.

As discussed above the photoreceptor belt 3, the charge corotron 6, the developer device 4, the transfer corotron 7, and the blade cleaner 5 may all be incorporated in a process cassette 1 having a housing 2 adapted to be removably mounted in the main assembly 100 of the xerographic copier 110.

The patents and applications referred to herein are hereby specifically and totally incorporated herein by reference.

From the foregoing it will be evident that various modifications may be made within the scope of the present invention. Thus, for example, instead of a flexible belt the imaging member may comprise a photoreceptor drum as commonly used in xerographic machines. Moreover, apart from the transfer corotron, the cassette may enclose additional or alternative processing means to those described above. In addition, while the invention has been illustrated with respect to copying apparatus it will be understood that it may be used in printer apparatus wherein a light beam such as a laser beam may be used to selectively discharge portions of the phototconductor. All such modifications and embodiments as may readily occur to the artisan are intended to be within the scope of the appended claims.

We claim:

1. A process unit adapted to be removably mounted in main assembly of a reproducing machine, comprising a housing enclosing an imaging member, and a charging device, wherein the charging device is provided with projections which engage an abutment forming part of the main assembly whereby the charging device isl located in a predetermined position relative to the main assembly when the process unit is inserted therein.

2. A process unit as claimed in claim 1 wherein the charging device is an elongate member having at least one projection at each of its two ends.

3. A process unit as claimed in claim 2 wherein one end of the charging devices has one projection and the other end of the charging device has tow projections.

4. A process unit as claimed in claim 3 wherein the two projections at said other end of the charging device are disposed laterally relative to the axis of the charging device.

5. A process unit as claimed in claim 3 wherein the two projections at said other end of the charging device are disposed longitudinally relative to the elogate charging device, one of said two projections being more protrusive than the other.

6. A process unit as claimed in claim 5 wherein the two projections are present at the end of the charging device which is the leading end when the process unit is inserted into the main assembly, the leading projection being more protrusive than the trailing projection.

7. A process unit as claimed in claim 1 wherein the charging device is as charge corotron for charging the imaging member and is enclosed within the housing.

8. A process unit as claimed in claim 7 comprising spring means which bias the charge corotron towards the abutment in the main assembly.

9. A process unit as claimed in claim 1 wherein the charging device is a transfer corotron for transferring an image from the imaging member to a copy sheet, and is mounted on the housing to form an integral part thereof.

10. A process unit as claimed in claim 9 wherein one end of the transfer corotron is retained by latch means adatped to release said one end of the transfer corotron when the process unit is inserted into the main assembly.

11. A process unit as claimed in claim 1 wherein the imaging member is an endless flexible belt loosely retained in the process unit when the process unit is removed from the main assembly and is adapted to be supported in a predetermined operative position by support means in the main assembly when the process unit is inserted into the main assembly.

12. A reproducing machine comprising a main assembly, a process unit adapted to be removable mounted in said main assembly, said process unit comprising a housing enclosing an imaging member and a charging device wherein the charging device is provided with projections which engage an abutment forming part of the main assembly, said main assembly having an abutment which engages the projections on the charging device of the process unit when the process unit is inserted in the main assembly to locate the charging device in a predetermined position relative to the main assembly.

13. A reproducing machine as claimed in claim 12, comprising support means in the main assembly for supporting the imaging member in an operative position when the process unit is inserted in the main assembly, wherein the abutment for the projections on the charging device is provided by said supporting means.

14. A reproducing machine as claimed in claim 13 wherein the imaging member is an endless flexible belt loosely retained in the process unit when the process unit is removed from the main assembly and is adapted to be supported in a predetermined operative position by siad support means in the main assembly when the process unit is inserted into the main assembly.

15. A reproducing machine as claimed in claim 12, wherein two projections are provided at the end of the charging device which is the leading end when the process unit is inserted into the main assembly, the leading projection being more protrusive than the trailing projection and wherein a recess is provided in the abutment to accommodate the more protrusive projection when the process unit is fully inserted in the main assembly.

16. A reproducing machine as claimed in claim 12, wherein the charging device is a charge corotron for charging the imaging member and is enclosed in the housing and further comprising spring means which bias the charge corotron towards the abutment in the main assembly.

17. A reproducing machine as claimed in claim 12 wherein upon insertion of the process unit into the main assembly the charging device is located in the main assembly independently of the remainder of the process unit.

* * * * *